United States Patent [19]

Amato

[11] Patent Number: 4,628,300

[45] Date of Patent: Dec. 9, 1986

[54] MOTOR VEHICLE LOCK COVER DEVICE

[76] Inventor: Louis Amato, 69 Winfield Ave., Staten Island, N.Y. 10305

[21] Appl. No.: 740,535

[22] Filed: Jun. 3, 1985

[51] Int. Cl.[4] ..... E05B 45/06; E05B 17/00

[52] U.S. Cl. ..... 340/542; 340/541; 340/63; 292/346; 70/89; 70/237; 180/287; 180/289; 49/348; 307/10 AT

[58] Field of Search ..... 340/542, 541, 540, 545, 340/546, 63; 292/346, 347, 336.3, 216; 70/89, 416, 90, 418, 237; 180/173, 287, 289; 49/374, 373, 348; 307/10 R, 10 AT

[56] References Cited

U.S. PATENT DOCUMENTS

| | | | |
|---|---|---|---|
| 1,863,487 | 6/1932 | Kirkpatrick | 292/346 |
| 2,690,350 | 9/1954 | Shapiro | 49/373 |
| 3,147,035 | 9/1964 | Lichtig | 49/373 |
| 3,279,840 | 10/1966 | Barone | 292/346 |
| 4,113,294 | 9/1978 | Bierman | 292/346 |
| 4,205,868 | 6/1980 | Kurth | 292/347 |
| 4,383,709 | 5/1983 | Ronan | 292/346 |

*Primary Examiner*—Donnie L. Crosland
*Attorney, Agent, or Firm*—Gloria K. Koenig

[57] ABSTRACT

A motor vehicle theft deterring device designed to prevent access to the levers which control the operating of the door lock in a vehicle door. A cover strip of rigid material of predetermined length and width to substantially cover the space between the vehicle window glass and the outside panel of the vehicle door is formed with a downwardly extending support strip and a mounting plate at a right angle to one edge of the cover strip, the plate being attached to the sash of the automobile window to prevent the insertion of a rod or similar device to release the lock actuating levers in the vehicle door. In a modified form of the invention, an electrical switch is positioned in the mounting plate and is electrically connected to the horn relay to cause the horn to blow continuously in the lock cover is tampered with and the horn circuit is grounded by movement of the switch.

8 Claims, 12 Drawing Figures

MOTOR VEHICLE LOCK COVER DEVICE

BACKGROUND OF THE INVENTION

1. Field of the Invention

This invention relates to a theft deterring device to be installed in motor vehicles such as cars, vans and trucks to prevent an unauthorized person from inserting a stiff rod or rigid flat strip of material into the space between the vehicle door window and the outside panel of the door to release the lock actuating levers in a vehicle door. The invention provides a rigid strip of material formed to be mounted on the sash of the vehicle window to substantially cover the space between the vehicle window glass and the outside panel of the door at a predetermined distance below the window sill preventing the insertion of a rigid rod or strip to reach the levers which control the door lock. In a modification of the invention an electrical switch which is connected to the horn is installed in the device to cause the horn to blow continuously if the device is tampered with in any way.

2. Description of Related Art

The general concept of using angled metal devices to block access to locks is known, but none has been adapted for mounting or use on a motor vehicle door. For example, both KIRKPATRICK, U.S. Pat. No. 1,863,487 and BARONE, U.S. Pat. No. 3,279,840, disclosing a body member of generally angle-shaped configuration to provide a shield to prevent the insertion of a celluloid strip or other tool into the crevice between a house door and jamb to slide the bolt into the unlocked position. In specific reference to motor vehicles, BIERMAN, U.S. Pat. No. 4,113,294, teaches an anti-theft clip for securing a lock cylinder to a car door consisting of panels attached to resilient legs which straddle and hold the lock cylinder, but the device does not protect against the downward insertion of a stiff rod to reach the lock levers. KURTH, U.S. Pat. No. 4,205,868 discloses a safety installation for the locking and unlocking of motor vehicle doors which includes a recessed sliding actuating knob covered by a transparent plate on the top side of the window sill. This device appears to require a specially designed door to accommodate the device.

SUMMARY OF THE INVENTION

This invention relates to a device designed to prevent the unauthorized entry into a motor vehicle by the use of a stiff wire or metal strip to reach and manipulate the levers which extend from the various lock controls installed in the door to the door lock and thereby open the lock without the use of a key. In an ordinary vehicle, a thief can reach the levers by inserting a stiff wire into the space between the vehicle window and door panel to push and pull the levers until the lock is released.

It is an object of this invention to provide a device which is mounted on the window sash which holds the movable windows in the side doors of most motor vehicles. The device comprises a strip of rigid material, referred to as the cover strip, of predetermined length and width to substantially cover the space between the vehicle window glass and the outside panel of the vehicle door and a rigid support strip which extends downwardly along the length of one edge of the cover strip at a right angle to the cover strip and which is formed with a rigid mounting plate extending downwardly from the center portion of the free edge of the support strip at a right angle to the cover strip. The mounting plate is formed with at least two openings through which bolts or other attaching means are inserted to fixedly mount the plate on to the face of the vehicle window sash. The height of the mounting plate is predetermined so that the cover strip is recessed below the window sill when the window is closed. The mounted device moves up and down with the vehicle window as the window is raised and lowered either manually by means of a hand crank or by means of a solenoid in electrically operated windows.

In a modified form of this invention, an electrical switch is mounted in an opening formed in the center portion of the mounting plate. The switch is electrically connected to the horn relay which is located in the motor compartment of the vehicle. If the device is pried away from the glass or tampered with, the switch plunger will extend to complete a circuit to the horn relay, causing the horn to blow continuously, thus frightening a thief away from the vehicle.

Thus, a further object of this invention is to provide a motor vehicle lock cover device which is easy to manufacture and install and can be adopted for use on motor vehicles having doors and windows of various sizes.

A further object of this invention is to provide a motor vehicle lock cover device which permits the opening and closing of the side windows in the normal way.

DESCRIPTION OF THE PREFERRED EMBODIMENTS

Figure 1:
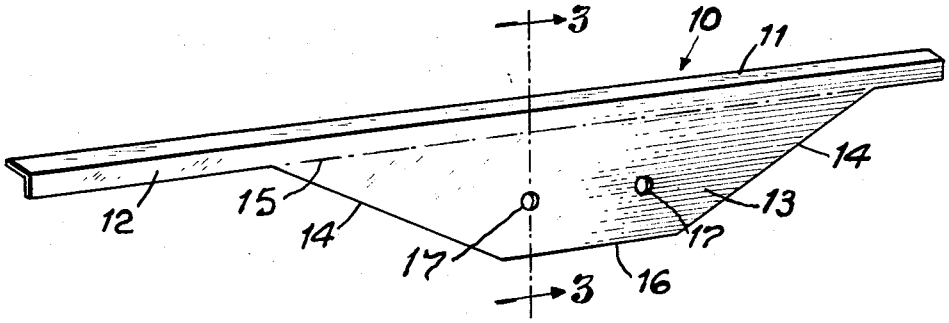
FIG. 1 is a perspective view of the motor vehicle lock cover device.
Figure 2:
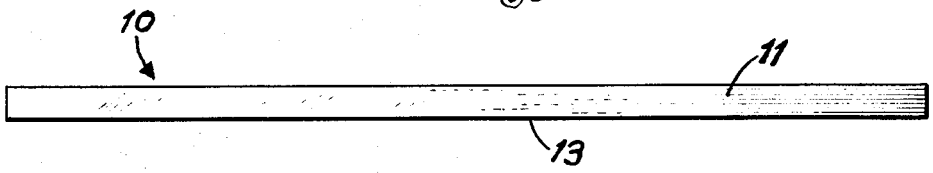
FIG. 2 is a top view of the device.

Referring now to the drawings, wherein throughout the several view like parts are designated by the same numeral, there is shown in FIG. 1 a motor vehicle lock cover designated generally by the numeral 10. A strip 11 of rigid material, such as stainless steel or aluminum, referred to as the cover strip, is formed with a predetermined length and width to substantially cover the space 25 between the vehicle window glass 23 and the outside door panel 21. A rigid support strip 12 is formed to extend downwardly along the length of one edge of the cover strip at a right angle to the cover strip 11. The support strip 12 strengthens the cover strip 11 and prevents the cover strip from being bent or displaced if an intruder inserts a stiff rod into the space between the door panel 21 and the window glass 23.

As shown in all of the drawings, the support strip 12 is equal in length to the cover strip 11, but it is to be understood that the support strip can be slightly shorter in length than the cover strip at either or both ends so long as it serves to strengthen the cover strip against bending by an intruder who is inserting a stiff rod.

Figure 3:
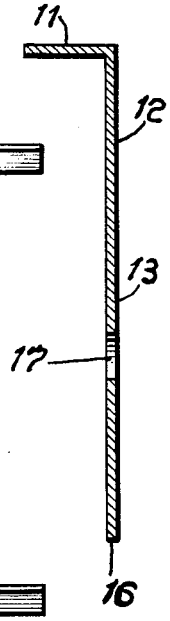
FIG. 3 is a sectional view taken on line 3—3 of FIG. 1.
Figure 4:
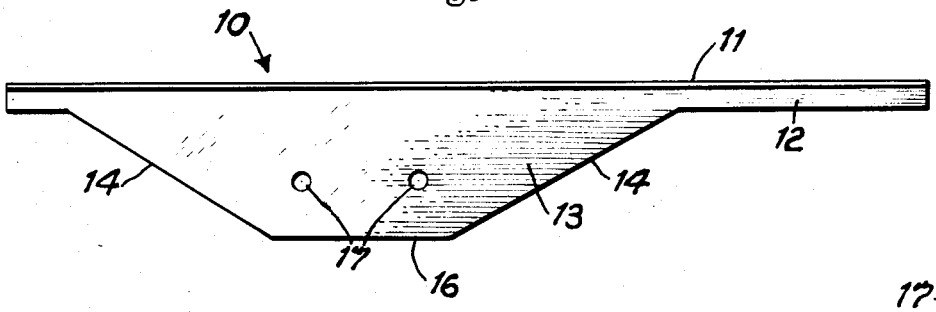
FIG. 4 is a side elevation view.

A rigid mounting plate 13 is formed to extend downwardly from the free edge of the support strip 12 at approximately the center portion of the support strip and at a right angle to cover strip 11, the face of the support strip 12 and mounting plate 13 being in alignment. As shown in FIG. 3, the sectional view of the device has an inverted L-shaped configuration. For ease of description, the portion of the mounting plate 13, which is contiguous to the edge of the support strip 12, is referred to as the upper base 15 while the lower end of the mounting plate is referred to as the lower base 16. The opposed ends of the rigid strips 11 and 12 extend beyond the ends of the upper base 15 of the mounting plate 13 in order to leave the internal area of the vehicle door as unobstructed as possible, while covering the entire space 25 between the outer panel of the door and the window glass. The mounting plate 13, as a whole, need not be exactly centered in respect to the length of the support strip 12, but is positioned so that the lower base portion 16 meets the window sash 24 of the vehicle.

The device may be made by precutting a flat rectangular panel of rigid material formed with a mounting plate of predetermined height and width extending from one edge and then bending the panel at a right angle along its longitudinal dimension to form two strips at right angles to each other with the mounting plate extending from one strip. Alternatively, the device may be made in separate pieces which are attached by welding or other means.

The mounting plate 13 is formed with a plurality of openings 17 drilled to receive bolts 18 which are used to secure the mounting plate 13 to the window glass sash 24. Other means to secure the mounting plate 13 to the window sash, such as clips, may also be used. The height of the mounting plate between its lower and upper bases is predetermined in accordance with the size of the door and the distance from the window sill 19 to the window sash 24, so that when the mounting plate is secured to the sash, the cover strip 11 is recessed below the outer window sill 19.

Figure 5:
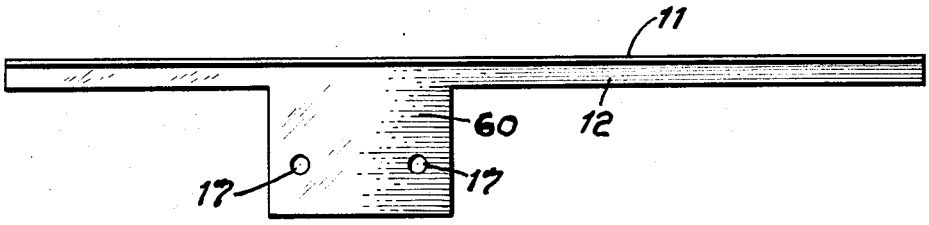
FIG. 5 is a side elevation view showing a modified form of mounting plate.
Figure 6:
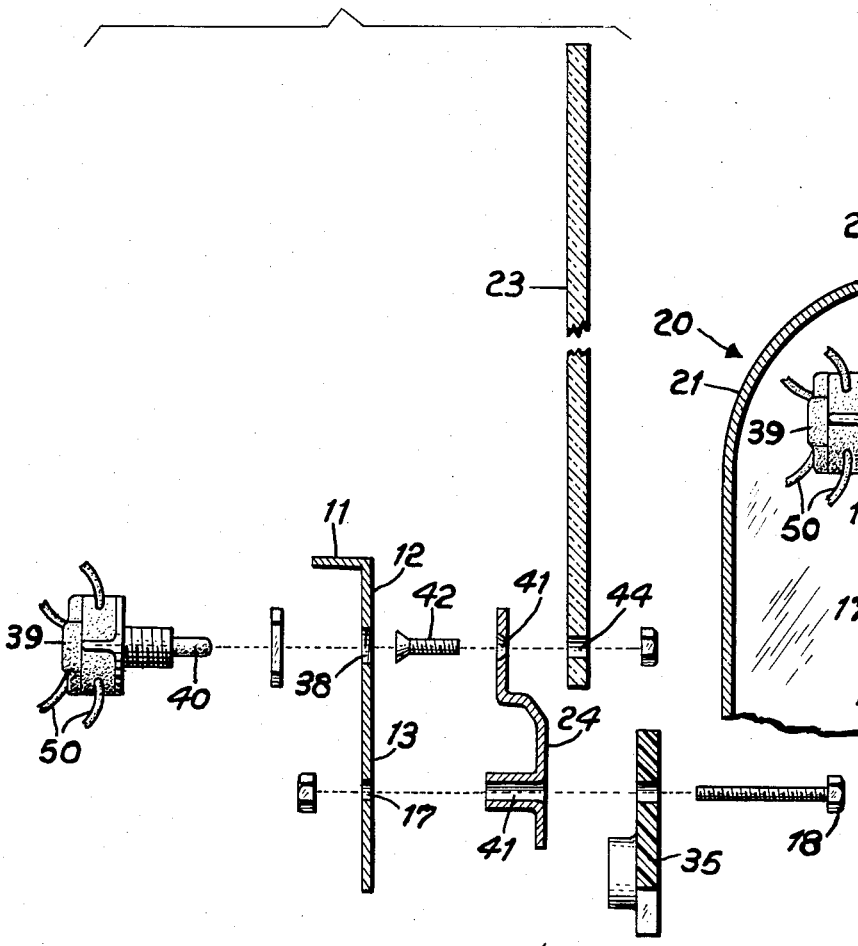
FIG. 6 is an enlarged exploded side view of the device mounted on a window sash.

As shown in the drawings, except FIG. 5, the mounting plate is trapezoidal in shape, with the lower base 16 substantially parallel to one edge of the support strip 12 and with outwardly slanting sides 14 extending from the lower base 16 of the plate to the upper base 15. The slanting sides give added strength to the plate. However, it is to be understood that the mounting plate can be rectangular 60 as shown in FIG. 5 or can be modified in shape to fit any special window sash which may be installed in a vehicle.

As noted above, the position of the mounting plate 13 in respect to the longitudinal dimension of the support strip 12 depends on the position of the window glass sash 24 in the vehicle door. As illustrated in the figures, the mounting plate 13 which was designed to fit onto the window sash of a 1981 Oldsmobile Omega model automobile was constructed to be closer to one end of the strip than to the other end to meet the window sash. As an illustration, for a 1981 Oldsmobile Omega model automobile the cover strip 11 is 20 inches (50 cm.) long and approximately one-half inch (1.3 cm.) wide, and the support strip is 20 inches (50 cm.) long with a height of approximately one-half inch (1.3 cm.). The mounting plate 13 has an upper base 15 width of approximately 13 inches (33 cm.), a lower base 16 width of approximately 4 inches (10 cm.), and a height from the lower base 16 to the upper base 15 of approximately 4 inches (10 cm.). The sides 14 extend to approximately $5\frac{1}{4}$ inches (13.3 cm.) of one end of the support strip 12 and $1\frac{3}{4}$ inches (4.4 cm.) of the second end of the support strip. The openings 17 in the mounting plate are drilled to hold three-sixteenths inch (0.5 cm.) bolts. The aforesaid dimensions fit 1981 to 1984 Oldsmobile Omega cars and 1980 to 1984 Buick Skylark models. When the mounting plate is secured to the window sash, the cover strip is recessed approximately one inch (2.5 cm.) below the window sill.

The device is installed by removing the inside panel of the vehicle door to expose the window sash. In most late model automobiles, the window sash 24 is a plate formed with openings 41 to receive bolts and the window glass 23 is formed with matching openings 44. The glass is fastened to the sash by means of bolts 42 through the matching openings. The window sash 24 is formed with a second set of openings 41 to connect the sash to the window regulator plate 35 and mounting plate 13 by means of bolts 18. A window regulator (rod and toothed wheel shown generally by numeral 37) allows a person to raise or lower the window by turning the handle 36 which is mounted on the inside panel 22 of the vehicle door.

To install the lock cover, the bolts 18 and 42 are removed from the window sash, the mounting plate 13 is drilled to form openings 17 to match the openings 41 in the window sash plate 24 and the lock cover is secured to the sash 24 by means of bolts 18 or by other fastening means. There may be some variation in the structure of the window sash in various model vehicles, but the fastening means to be used to secure the mounting plate to the sash will be obvious to those skilled in the art.

Figure 10:
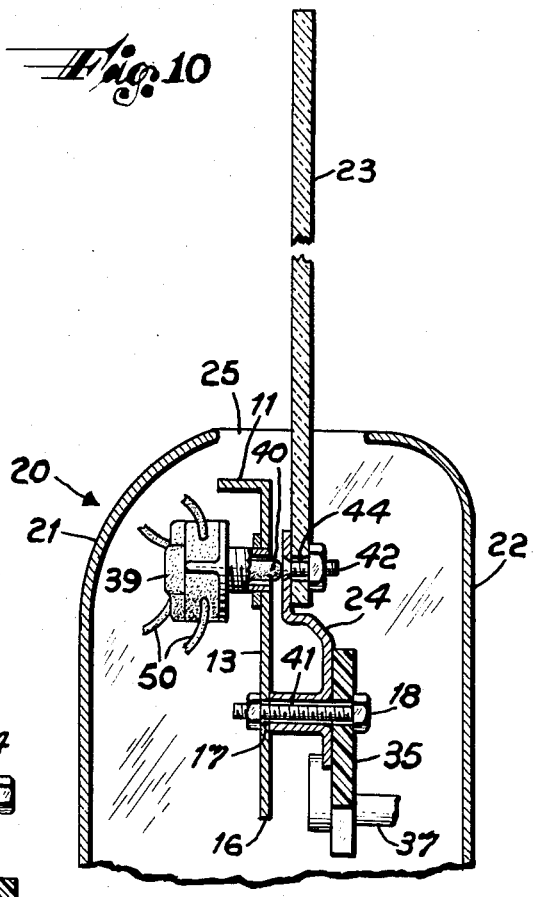
FIG. 10 is a sectional view along line 10—10 of FIG. 9.
Figure 7:
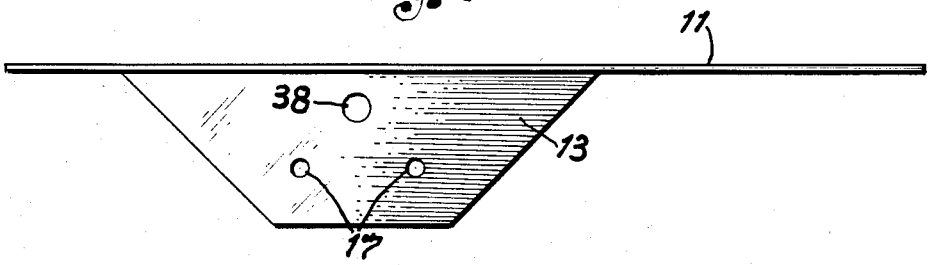
FIG. 7 is an elevation view of a modified form of the device.
Figure 8:
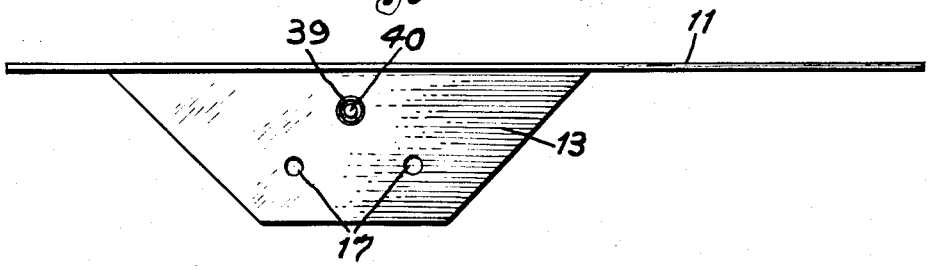
FIG. 8 is an elevation view of the modified form of the device shown in FIG. 7 with a switch secured in the mounting plate.
Figure 11:
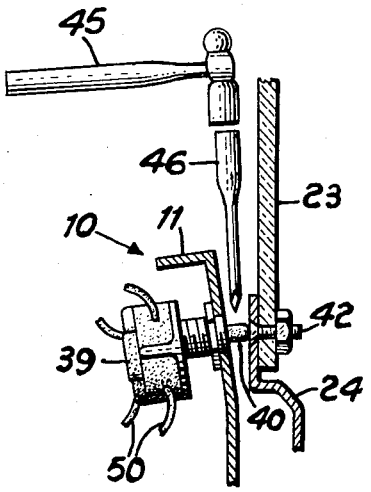
FIG. 11 is a sectional view as shown in FIG. 10 of the modified form of the device after the device has been tampered with, omitting bolts and window regulator connections.

In a modified form of this invention, electrical switch means are secured to the mounting plate. The switch is of the normally open type and is electrically connected to the horn relay system, the switch being of the type which will close the circuit to the horn when the switch is moved, as by tampering with the lock cover. In order to secure the switch, the mounting plate may be formed with an additional opening 38. A switch 39 having a movable plunger 40 is secured in the opening 38. The switch 39 is of the normally-open type when the plunger 40 is compressed within the body of the switch. Such switches are readily commercially available. The switch 39 is electrically connected by wires, shown generally by the numeral 50, to the horn relay 56 which is located in the motor compartment 59 of the vehicle. As shown in FIG. 10, the switch 39 is mounted against the glass 23 so that the plunger 40 is compressed by the glass within the switch body 39 and the circuit to the horn relay 56 is open. As shown in FIG. 11, if the rigid strip is pried away from the glass or is tampered with by means of, for example, a hammer 45 and chisel 46, the device 10 is forced away from the glass 23, the plunger 40 of the switch 39 extends out of the switch body, thereby completing a circuit to the horn relay 56 which causes the automobile horn 57 to blow continuously. The switch 39 must be disarmed, or a wire must be disconnected at the relay, to stop the horn from blowing.

Figure 12:
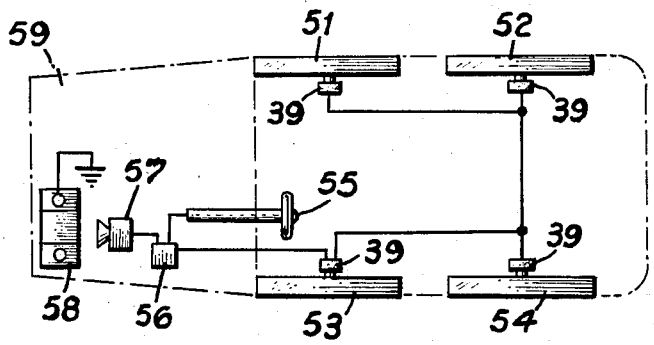
FIG. 12 is a schematic view of the electrical connections used with the modified form of the invention.

As shown schematically in FIG. 12, for a four door vehicle, each of the doors, namely the right front door 51, right rear door 52, left front door 53 and left rear door 54 is provided with an electrical switch 39 mounted in the lock cover device as described above; the switches are electrically connected to the horn relay 56 located in the motor compartment 59 of the vehicle. The horn relay is electrically connected to the horn 57 with the entire system being energized by the battery 58. As is understood, the horn relay is also energized by manually pressing the horn button 55.

Figure 9:
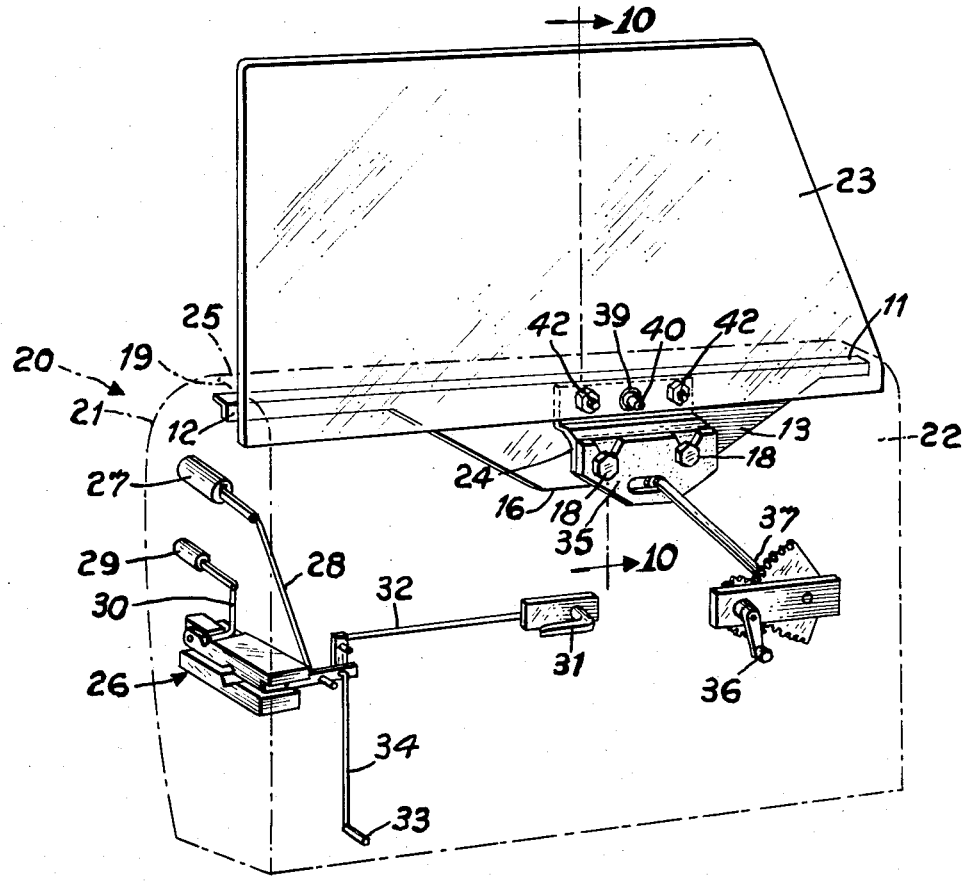
FIG. 9 is a side perspective, partially sectional view of the modified form of the device mounted in a conventional vehicle door, showing only parts related to this invention.

The utility of the lock cover device is best illustrated by reference to FIG. 9. A modern vehicle door lock is controlled by four levers installed between the outside panel 21 and inside panel 22 of the door 20. The outer door handle (not shown) for opening the door has a push button or similar device 27 connected to a lever 28; the lock cylinder 29 which permits the driver to open or lock the door from the outside with a key is connected to lever 30; th release handle 31 located inside of the door is connected to lever 32; and the inside push-button or sliding lock lever 33 used to lock and unlock the door from the inside is connected to lever 34. All of the levers are connected to the door lock 26.

In respect to the inside lock control 33, it should be noted that where the lock control comprises a horizontally sliding lever recessed within the door below the window sill (not shown), the present invention will prevent tampering with the lever 34. However, if the inside lock control consists of a push button extending upward from the window sill, a thief could gain entry to the car by forcing a rod through the weatherstripping surrounding the window frame and manipulating the button to release the lock. While it does not form a part of this invention, it has been found that it is a relatively simple mechanical operation to reverse the lever 34 and connect it to a push button 33 installed at a lower position on the inside panel 22 of the door, as shown in FIG. 9. This repositioning of the window sill lock permits the lock cover to effectively cover all of the levers controlling the lock and thus, protect the vehicle from unauthorized entry. As noted above, the installation of the lock cover does not interfere with the operation of the various lock levers, all of which can be operated in the normal way.

The foregoing is considered as illustrative only, and while specific embodiments have been described with some particularity, many modifications and variations of those embodiments will occur to those skilled in the art without deviating from the invention. Accordingly, it is to be understood that, within the scope of the appended claims, the invention may be practiced other than as specifically described or shown.

What is claimed herein is:

1. A motor vehicle lock cover protective device for a motor vehicle door having an outside door panel, a door lock with a plurality of levers controlling the locks, window glass and a window sash designed to hold the window glass, comprising:

(a) a cover strip of rigid material of predetermined length and width to substantially cover the space between the vehicle window glass and the outside panel of the vehicle door;

(b) a rigid support strip extending downwardly along the length of one edge of the cover strip at a right angle to the cover strip;

(c) a rigid mounting plate extending downwardly from the free edge of the support strip at a right angle to the cover strip, the plate having an upper base along the edge of the support strip, a lower base and two sides, the opposed ends of the strips extending beyond the ends of the upper base of the mounting plate; and (d) means to fixedly secure the mounting plate to the window sash for movement therewith, the mounting plate being positioned at a predetermined distance along the length of the support strip and being of predetermined height from the lower base to the upper base whereby the mounting plate extends to the window sash for securing thereto and the cover strip is held in a position recessed below the window sill.

2. A lock cover in accordance with claim 1 wherein the cover strip and the support strip are equal in length.

3. A lock cover in accordance with claim 1 wherein the mounting plate is formed with a plurality of openings to match openings in the window sash, the securing means passing through the matched openings to secure the mounting plate to the sash.

4. A lock cover in accordance with claim 3 wherein the securing means comprise bolts.

5. A lock cover in accordance with claim 1 wherein the mounting plate is trapezoidal in shape, with the lower base substantially parallel to the upper base and with outwardly slanting sides extending from the lower base of the plate to the edge of the support strip.

6. A lock cover in accordance with claim 1 wherein the mounting plate is rectangular in shape.

7. A lock cover in accordance with claim 1 wherein electrical switch means of the normally-open type are secured on the mounting plate and electrically connected to the horn relay system to close the circuit to the horn when the switch means are moved.

8. A lock cover in accordance with claim 7, wherein:

(a) the mounting plate is formed with an opening to receive the electrical switch means; and (b) the electrical switch means comprise a body member having a movable plunger, the body member being secured in the opening of the mounting plate, the circuit being open when the plunger is compressed within the body member, and the plunger being held in its compressed position against the window glass, the plunger extending out of the body member to complete the circuit to the horn when the mounting plate is moved away from the glass.

* * * * *